US010478829B2

(12) United States Patent
Bhambhani et al.

(10) Patent No.: US 10,478,829 B2
(45) Date of Patent: Nov. 19, 2019

(54) COLLECTOR COMPOSITIONS AND METHODS OF USING SAME IN MINERAL FLOTATION PROCESSES

(71) Applicant: CYTEC INDUSTRIES INC., Princeton, NJ (US)

(72) Inventors: Tarun Bhambhani, New York, NY (US); Jason Freeman, Spring Hill, TN (US); Devarayasamudram R. Nagaraj, Ridgefield, CT (US)

(73) Assignee: Cytec Industries Inc., Princeton, NJ (US)

( * ) Notice: Subject to any disclaimer, the term of this patent is extended or adjusted under 35 U.S.C. 154(b) by 166 days.

(21) Appl. No.: 15/358,626

(22) Filed: Nov. 22, 2016

(65) Prior Publication Data

US 2017/0144168 A1 May 25, 2017

(30) Foreign Application Priority Data

Nov. 25, 2015 (EP) ..... 15196392

(51) Int. Cl.

| | |
|---|---|
| ***B03D 1/008*** | (2006.01) |
| ***C22B 3/00*** | (2006.01) |
| ***C22B 15/00*** | (2006.01) |
| ***B03D 1/01*** | (2006.01) |
| ***B03D 1/012*** | (2006.01) |

(52) U.S. Cl.

CPC ..... *B03D 1/008* (2013.01); *B03D 1/01* (2013.01); *B03D 1/012* (2013.01); *C22B 3/00* (2013.01); *C22B 15/0063* (2013.01); *B03D 2201/02* (2013.01)

(58) Field of Classification Search

CPC ..... C22B 3/00; B03D 1/008

See application file for complete search history.

(56) References Cited

U.S. PATENT DOCUMENTS

| | | | | |
|---|---|---|---|---|
| 3,933,872 | A | 1/1976 | Hartlage | |
| 4,427,772 | A * | 1/1984 | Kodera | G01N 27/4163 204/403.14 |
| 4,871,466 | A | 10/1989 | Wang et al. | |
| 5,237,079 | A | 8/1993 | Wang et al. | |
| 6,145,667 | A | 11/2000 | Rothenberg et al. | |
| 6,739,454 | B2 | 5/2004 | Rothenberg et al. | |
| 7,007,805 | B2 | 3/2006 | Hughes | |
| 7,049,452 | B2 | 5/2006 | Hughes | |
| 8,720,694 | B2 | 5/2014 | Nagaraj et al. | |
| 2012/0076717 | A1 | 3/2012 | Yoon et al. | |

FOREIGN PATENT DOCUMENTS

| | | | |
|---|---|---|---|
| EP | 0311759 | A2 | 4/1989 |
| EP | 1309543 | B1 | 12/2008 |
| FR | 2633606 | B1 | 3/2012 |
| WO | 2003011470 | A1 | 2/2003 |

OTHER PUBLICATIONS

International Search Report of PCT/US2016/063267; dated Mar. 3, 2017.

Written Opinion of PCT/US2016/063267; dated Mar. 3, 2017.

International Preliminary Report on Patentability of PCT/US2016/063267; dated Jun. 7, 2018.

Lee K. et al., "Flotation of mixed copper oxide and sulphide minerals with xanthate and hydroxamate collectors;" Minerals Engineering, vol. 22, pp. 395-401; 2009.

* cited by examiner

*Primary Examiner* — Melissa S Swain

(74) *Attorney, Agent, or Firm* — Charles E. Bell, Esq.

(57) ABSTRACT

Collector compositions C for mineral flotation, which include at least one of a hydroxamic acid A, and/or a salt S of a hydroxamic acid A solubilized in a water-soluble organic solvent L, and processes for using same for recovering sulfide and/or oxide minerals in mineral flotation processes are provided herewith.

28 Claims, No Drawings

COLLECTOR COMPOSITIONS AND METHODS OF USING SAME IN MINERAL FLOTATION PROCESSES

CROSS-REFERENCE TO RELATED APPLICATIONS

This application claims benefit of priority from European Application No. 15196392.3 filed Nov. 25, 2015, the entirety of which is incorporated herein by reference.

BACKGROUND OF THE INVENTION

1. Field

The technology field of the inventions described herein relate generally to ore beneficiation. More specifically, the technology field of the inventions relate to mineral flotation, and the use of flotation reagents for the beneficiation of ore containing oxide and/or sulfide minerals.

2. Related Art

Fatty alkyl, aryl and aralkyl hydroxamic acids and their salts are well known collectors for the flotation of oxide and sulfide minerals. Hydroxamic acids are formally derived from carboxylic acids X—COOH by replacing the hydroxyl group —OH with a hydroxyamine group —NY—OH. X stands for the alkyl, aryl or aralkyl group, and Y is mostly hydrogen H, or lower alkyl such as methyl. Hydroxamic acids have been used for the flotation of metals or minerals such as pyrochlore, fluorite, huebnerite, wolframite, cassiterite, muscovite, phosphorite, hematite, pyrolusite, rhodonite, chrysocolla, malachite, barite, calcite, and rare-earth containing minerals. In addition, their use for the flotation of sulfide minerals such as chalcopyrite, pyrite, and pyrrhotite has been well documented in the prior art. They are more powerful and more selective than conventional fatty acids, fatty amines, petroleum sulfonates, and alkyl sulfates. Hydroxamates are particularly useful in mineral flotation processes of oxide copper minerals such as malachite, azurite, cuprite, tenorite, pseudomalachite, chalcanthite and chrysocolla.

The fatty alkyl hydroxamic acids are typically prepared by reacting, in an appropriate solvent, a form of hydroxylamine (hydroxylamine or a compound thereof, typically its hydrochloride or sulfate salt) with a fatty acid methyl ester in the presence of a base. The resulting fatty hydroxamate salt, which is a solid, can be neutralized with acid to give the corresponding fatty hydroxamic acids, which are also solids.

Prior art by Hughes (U.S. Pat. No. 7,049,452 B2 and U.S. Pat. No. 7,007,805 B2) discloses the preparation and use of a solid or paste product of fatty hydroxamic acid and its salt. Hartlage (U.S. Pat. No. 3,933,872 A) also discloses a method for preparation of fatty hydroxamate salt in the form of a solid product. However, products in solid or paste form have several disadvantages: a solid or paste-like product is more difficult to handle at the mining operation as the product has to be transformed into an aqueous solution or dispersion before use. Removal of solid product or viscous paste from drums can be difficult, and may also be dangerous if the paste is caustic, i.e., having a high pH. Most operations prefer that the alkyl hydroxamic acid or its salt is obtained at the mining operation in a liquid form that can be readily dosed into the flotation cells.

A liquid product may be obtained by providing the fatty hydroxamate in an aqueous mixture having a pH of at least 11, as described in U.S. Pat. No. 7,007,805 B2. This is done because the fatty hydroxamic acids and their corresponding alkali metal salts have poor solubility in water having a pH of less than about 11. Reagents having a pH of greater than 10 are considered hazardous or dangerous in the context of this invention. They can cause burns on contact with skin, and may permanently damage the skin. Flotation plant operators handling these reagents are often required to wear elaborate personal protective equipment to handle the hazardous slurry or liquid.

While FR 2,633,606 A1 discloses hydroxamic acids solubilized in "a solvent miscible with water," only a narrow class of solvents is provided, and one skilled in the art would presume that most include water as a primary solvent. Additionally, the reference teaches the use of hydroxamic acids as precipitation reagents for carbonate ores.

The hydroxamic acid may be dissolved in water-immiscible hydrocarbon or other oils, as described in U.S. Pat. No. 6,739,454 B2. However the use of such a solvent can have detrimental effects on the flotation process. The detrimental effects include increased frothing, stabilization of the froth phase, and flotation of unwanted gangue minerals. This is usually manifested in poor or unacceptable concentrate grades.

In U.S. Pat. No. 4,871,466 A, the preparation of fatty hydroxamic acid in a water insoluble solvent is described, namely an aliphatic alcohol having from 8 to 22 carbon atoms, or mixtures thereof. The presence of this water-insoluble alcohol can have detrimental effects in the flotation process, such as increased frothing, stabilization of the froth phase, and flotation of unwanted gangue minerals.

Alternatively, a micro-emulsion of the fatty hydroxamic acid may be prepared using aliphatic alcohols having from 8 to 22 carbon atoms, or mixtures thereof, with small amounts of cationic or a non-ionic surfactant as discussed in U.S. Pat. No. 5,237,079 A. The long-chain aliphatic alcohol used in the micro-emulsion can have similar detrimental effects on the flotation process as the oil in U.S. Pat. No. 6,739,454 B2, namely increased frothing, stabilization of the froth phase, and flotation of unwanted gangue minerals.

Accordingly, hydroxamic acid compositions suitable for use as mineral collectors for the beneficiation of ores in mineral flotation processes, which are in a liquid formulation but free from surfactants, long chain hydrocarbon solvents (e.g., ≥C6), or other oils that cause undesirable stabilization of the froth phase, increased frothing, and/or flotation of gangue minerals, would be advantageous. Moreover, such collector formulations that also demonstrate improved flotation recovery, improved concentrate grade, and lower mass recovery would be a useful advance in the art and could find rapid acceptance in the industry.

SUMMARY OF THE INVENTION

The foregoing and additional objects are attained in accordance with the principles of the invention wherein it is now disclosed that the hydroxamic acid compositions described herein are highly effective collectors in mineral flotation processes for the beneficiation of ores containing sulfide and/or oxide minerals and/or metals. The hydroxamic acid collector compositions described herein can be characterized as advantageously having a low content of water, fatty acid, surfactant, toxicity and/or flammability, and moderate pH.

These features lead to superior performance of the collector compositions described herein in mineral flotation processes as compared to collectors of the prior art, which can have detrimental effects in flotation, such as stabilization of froth phase, increased frothing and flotation of unwanted gangue minerals. Furthermore, flotation plant operators can handle these reagents with greater safety than other hydroxamic acid collector compositions in liquid form of the prior art.

Accordingly, in one aspect, the invention provides collector compositions C for mineral flotation having a water-soluble organic solvent L and at least one of a hydroxamic acid A, or a salt S of a hydroxamic acid A, dissolved therein. In reference to the invention described herewith, a solvent is considered water-soluble if it forms single-phase mixtures with water for compositions ranging from a mass fraction of solvent L in the mixture with water of from 0.04 up to 1, in a temperature range of from 15° C. to 80° C.

In another aspect, the invention provides methods of recovering an oxide and/or sulfide mineral in a mineral flotation process, by mixing a ground ore having an oxide and/or sulfide mineral with a hydroxamic acid composition according to the invention as herein described, and an effective amount of water in which to form a slurry; subjecting the slurry to a mineral flotation process; and separating the mineral values from the slurry to obtain an oxide and/or sulfide mineral concentrate.

These and other objects, features and advantages of this invention will become apparent from the following detailed description of the various embodiments of the invention taken in conjunction with the accompanying Examples.

DETAILED DESCRIPTION OF CERTAIN EMBODIMENTS

As summarized above, the present invention is based at least in part on the discovery that hydroxamic acids and/or salts of hydroxamic acids solubilized in a water miscible solvent provide improved performance as collector compositions for the beneficiation of ores containing sulfide and/or oxide minerals and/or metals via mineral flotation processes. As those skilled in the art will appreciate, ores contain, inter alia, both "value" and "non-value" minerals. In this context, "value" mineral(s) refer to the metal(s) or mineral(s) that are the primary object of the flotation process, i.e., the metals and/or minerals from which it is desirable to remove impurities. The term "non-value" mineral refers to the metal(s) or mineral(s) for which removal from the value mineral is desired, i.e., impurities in the value mineral. A non-value mineral is not necessarily discarded, and may be considered a value mineral in a subsequent process.

Various terms have been defined throughout the disclosure to assist the reader. Unless otherwise defined, all terms of art, notations and other scientific or industrial terms or terminology used herein are intended to have the meanings commonly understood by those of skill in the chemical and/or mining arts. In some cases, terms with commonly understood meanings are defined herein for clarity and/or for ready reference, and the inclusion of such definitions herein should not necessarily be construed to represent a substantial difference over the definition of the term as generally understood in the art unless otherwise indicated. As used herein and in the appended claims, the singular forms include plural referents unless the context clearly dictates otherwise. Throughout this specification, the terms retain their definitions in case of any conflict of definition.

As those skilled in the art will appreciate, any of the specified number ranges described herein are inclusive of the lowest value and of the highest value, and of any specific value there between (e.g., the range 1 to 100, or between 1 and 100, is inclusive of every value from 1 to 100 as if explicitly listed herein). Thus each range disclosed herein constitutes a disclosure of any sub-range falling within the disclosed range. Disclosure of a narrower range or more specific group in addition to a broader range or larger group is not a disclaimer of the broader range or larger group. The endpoints of all ranges disclosed herein are independently combinable with each other.

The transition phrase "comprises" or "comprising" as used herein includes embodiments "consisting essentially of" or "consisting of" the listed elements, and the terms "including" or "having" in context of describing the invention should be equated with "comprising".

Collector Compositions

1. Hydroxamic Acid A and Salt S of a Hydroxamic Acid

The hydroxamic acids A and/or salts S of hydroxamic acids suitable for use as collector compositions for use in mineral flotation processes according to the invention can be generally defined by the following structure:

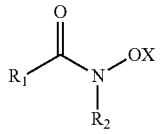

$R_1$=C5 to C21 alkyl $R_2$=H, lower alkyl

X=H, alkali metal, alkaline earth metal, ammonium wherein $R_1$, $R_2$ and X are as defined. Lower alkyl refers to alkyl groups having between 1 and 4 carbon atoms. The number of carbon atoms of the alkyl group of the preferred fatty hydroxamic acid Af used in this invention, including the carbon atom of the carboxyl group, is from 6 to 22. The alkyl groups can be linear or branched, saturated or singly or multiply unsaturated. In some embodiments, the number of carbon atoms of the fatty hydroxamic acid Af can be between 6 and 16. In other embodiments, the number of carbon atoms of the fatty hydroxamic acid Af can be between 8 and 12. Most preferred collector compositions include hydroxamic acids or salts having linear, saturated alkyl groups.

In certain embodiments, suitable hydroxamic acids A that can be used in collector compositions or methods according to the invention include, but are not limited to, aromatic hydroxamic acids such as benzohydroxamic acid, ethyl benzohydroxamic acids, the hydroxamic acid based on salicylic acid, alpha-naphthohydroxamic acid, beta-naphthohydroxamic acid, and cycloalkylhydroxamic acids such as cyclohexylhydroxamic acid and cyclopentyl hydroxamic acid.

The salts S of the hydroxamic acids A can include, but are not limited to, alkali metal salts, such as lithium, sodium, or potassium salts, or alkaline earth metal salts, such as magnesium or calcium salts, or also ammonium salts. Preferred salts of hydroxamic acids are alkali metal salts and ammonium salts. Particularly preferred are salts of lithium, sodium, and potassium.

Mixtures of one or more hydroxamic acid A and/or one or more salt S of a hydroxamic acid described herein can also be used in collector composition or methods according to the invention. In some embodiments, mixtures including a hydroxamic acid A and a salt S of the same hydroxamic acid A are preferred in the collector composition. In other embodiments, the collector composition can include mixtures of hydroxamic acid A having 8 to 12 carbon atoms. Collector compositions including mixtures of C8 and C10 hydroxamic acids are preferred. As those skilled in the art will appreciate, the hydroxamic acids and/or salts of hydroxamic acids can be present in any ratio. When the hydroxamic acid A or salt S of hydroxamic acid portion of the collector composition C is present as a mixture of 2 components, for example, the components can be present in a ratio from 30:70; 35:65; 40:60; 50:50; or the reverse thereof.

The sum of mass fractions $w_{AS}$ (sum $m_A+m_S$ of the mass $m_A$ of a hydroxamic acid A and/or the mass $m_S$ of a salt S of a hydroxamic acid present in the composition, divided by the total mass $m_C$ of the composition) of hydroxamic acid A and salt S of a hydroxamic acid present in the collector composition C can be from about 5% to about 80%, and preferably from 10% to 65%. In various embodiments, the total mass fraction of a hydroxamic acid A and/or a salt S of a hydroxamic acid in collector composition C can be from 8% to 70%; from 11% to 60%; from 14% to 50%; or from 17% to 45%. In a particular embodiment the total mass fraction of a hydroxamic acid A and/or a salt S of a hydroxamic acid in collector composition C is from 19% to 41%.

While the prior art is replete with methods for formation of hydroxamic acids or salts of hydroxamic acid (e.g., U.S. Pat. No. 6,145,667 to Rothenberg et al., or U.S. Pat. No. 7,007,805 to Hughes), the hydroxamic acids A and salts S of hydroxamic acids according to the invention are characterized in that they are solubilized in water-miscible solvents having low water and low fatty acid content.

While prior literature reference Organic Synthesis Coll. Vol. II, page 67 discloses a method of making hydroxamates derived from a carboxylic acid ester by reacting this ester with a mixture prepared from a solution of hydroxylamine hydrochloride in methanol with a solution of potassium hydroxide using methanol or lower alcohols as a reaction medium, the resulting hydroxamic acid salts precipitate out of the methanol solution. Additionally, in U.S. Pat. No. 3,933,872 A, a method of preparing the fatty acid hydroxamates is disclosed by reacting an anhydrous slurry of hydroxylamine sulfate in a lower alkanol solution of fatty acid methyl ester in the presence of dimethylamine.

However, the alkyl hydroxamate is precipitated upon neutralization with alkali metal hydroxide. In U.S. Pat. No. 7,007,805 B2, the use of methanol as a defoaming agent is taught, in the process of isolating the fatty hydroxamate paste. Although it is stated that methanol is present in the final composition, its mass fraction is less than 3%, and the primary solvent identified in U.S. Pat. No. 7,007,805 B2 is water. Thus, these references do not contemplate the use of methanol as a primary solvent for the storage and use/application of fatty hydroxamic acids or their salts.

The process for preparing the hydroxamic acids A and salts S of hydroxamic acids according to the invention generally involves methods known to those skilled in the art such as reacting an ester of an acid which is preferably a fatty acid having from six to twenty-two carbon atoms, with a hydroxylamine salt and a base in the presence of a water-immiscible organic solvent (such as toluene, xylenes, and other aromatic or aliphatic hydrocarbons), and water to produce a hydroxamate salt, preferably a fatty acid hydroxamate salt. An acid is then added to the hydroxamate salt, whereby an organic layer and an aqueous layer are formed. The organic layer which comprises the water-immiscible organic solvent and the hydroxamic acid is then separated from the aqueous layer. The organic solvent is then removed, preferably by distillation, to yield the hydroxamic acid A which, as described in more detail below, is subsequently solubilized in a water-soluble organic solvent L. In various embodiments, a base can be optionally added in a quantity sufficient (as determined by those skilled in the art using no more than routine experimentation) to convert at least a part of the hydroxamic acid A to a salt S of the hydroxamic acid A.

The prepared hydroxamic acid A and/or salts S of a hydroxamic acid is essentially free (i.e., mass fraction present at less than 1%) from starting methyl esters. In preferred embodiments, the mass fraction of these products in the hydroxamic acid A of the collector composition C is less than 0.5%.

2. Solvents

The water soluble organic solvents L suitable for use in solubilizing the hydoxamic acids A or salts S of hydroxamic acids to form the collector compositions C according to the invention are preferably selected from the following major families of water soluble organic solvents: alkylene glycols, aliphatic alcohols having from one to four carbon atoms, benzyl alcohol, polyhydric aliphatic alcohols having two or more hydroxyl groups per molecule, aliphatic sulfoxides, aliphatic sulfones, glycol ethers, aliphatic and aromatic amines, aliphatic and cycloaliphatic amides, cycloaliphatic esters, aliphatic hydroxyesters and others. Aliphatic as used herein comprises linear, branched and cyclic aliphatic compounds which may also have olefinic or acetylenic unsaturation. The water soluble solvents L may be used by themselves or in combination with other water soluble solvent L selected from the same or a different family, in any mass ratio.

A solvent L is considered to be water-soluble if it forms single-phase mixtures with water for compositions ranging from a mass fraction of solvent in the mixture of from 0.04 up to 1, (=from 4% to 100%) in a temperature range of from 15° C. to 80° C. In other words, monophasic aqueous solutions exist that have a mass fraction of at least 4% of solvent (i.e., solubility of at least 40 g/L in water).

Examples of water soluble organic solvents L include lower aliphatic alcohols having from one to four carbon atoms, viz., methanol, ethanol, n-propanol and isopropanol, n-butanol, isobutanol, tert.-butanol, and amyl alcohols which are less preferred due to their higher volatility; benzylalcohol; polyhydric alcohols having at least two hydroxyl groups per molecule such as ethylene glycol, 1,2-propanediol (commonly known as propylene glycol), 1,3-propanediol, 1,2-butanediol, 1,3-butanediol, 1,4-butanediol, 2,3-butanediol, 1,2-pentanediol, 1,5-pentanediol, 1,6-hexanediol, and glycerol; glycol ethers such as diethyleneglycol, dipropyleneglycol dimethylether, phenoxyethanol, 2-ethoxyethanol, 2-methoxyethanol, 2-butoxyethanol, propylene glycol n-propyl ether, and propylene glycol n-butyl ether; amines like ethanolamine, morpholine, and pyridine; amides like dimethylformamide, diethylformamide, N-methyl pyrrolidinone, hydroxyethyl pyrrolidinone; sulfoxides and sulfones such as dimethylsulfoxide, tetramethylene sulfoxide (tetrahydrothiophene-1-oxide), and tetramethylene sulfone (sulfolane); cyclic esters such as propylene carbonate; hydroxyesters such as butyl lactate; cyclohexanone; and mixtures of two or more of these solvents mentioned.

In certain embodiments, the glycol ethers can include at least one, and up to three, oxyalkylene groups with two or three carbon atoms in the alkylene group, and at least one ether bond in their molecules. In the same or other embodiments, the glycol ethers may be etherified with linear or branched aliphatic monofunctional alcohols having from one to seven carbon atoms.

In certain embodiments, the solvent L can include aliphatic glycols having from two to six carbon atoms, such as ethylene glycol, propylene glycol, 1,3-dihydroxypropane, 1,2-dihydroxybutane, 1,4-dihydroxybutane, and 1,2- and 1,6-di-hydroxyhexane. In other embodiments, the preferred solvent L can be propylene glycol or mixtures of any two or more of propylene glycol, 1,2-butanediol, 2,3-butanediol, glycerol, benzyl alcohol, propylene glycol n-propyl ether, phenoxyethanol, n-butanol, 2-propanol, isopropanol, dimethylsulfoxide, hydroxyethyl pyrrolidone, and N-methyl pyrrolidone. In the same or other embodiments, the preferred solvent L can include mixtures of propylene glycol with other aliphatic alcohols or aliphatic diols.

While a residual amount of water may be present in any embodiments of the collector composition C contemplated or described herein, it's preferable that the collector composition C have a low water content (i.e., the mass fraction $w_{H2O}$ of water present in the composition C is preferably not greater than 10%). In any of the embodiments described herein, the mass fraction of water can be not greater than 5%, and most preferably, not greater than 1.0%. In some embodiments, the collector composition C is essentially free of water (i.e., the mass fraction of water is present at less than 1%).

The collector compositions C according to the invention can also be characterized as having a low content of surfactant (i.e., the mass fraction of surfactant present in the composition C is preferably not greater than 10%). Preferred embodiments of the collector composition C contain less than 5%, and more preferably less than 1% of a mass fraction of surfactant. In some embodiments, the collector composition C can be considered essentially free of surfactant (i.e., the mass fraction of surfactant is present at less than 1%).

In any of the embodiments contemplated or described herein, the mass fraction of the solvent L in the collector composition C can be between 95% and 5%, and is preferably between 95% and 20%. If further constituents are used in the collector composition C, the mass fraction of solvent L in the composition C will be lower than 95%, but it is preferably at least 15% or greater, and more preferably, at least 10% or greater.

Mineral Flotation Processes

The methods according to the present invention apply to the use of the composition C in mineral flotation processes used for the selective separation of metals and minerals from their ores. Flotation methods are well established and are known to those of ordinary skill in the art. In the context of this invention "oxide minerals" are minerals containing the desired oxides, such as metals in the form of their oxides, or oxygen-containing inorganic compounds.

A mineral flotation process can generally include, but is not limited to, the steps of a) grinding an ore containing minerals to be separated b) mixing the ground ore with water and the collector composition C which renders the mineral of choice to be hydrophobic, thereby forming a slurry, also designated as "pulp", c) subjecting the slurry to a flotation process by passing air or fluid through the slurry causing the flotation of desired minerals, and d) separating the froth from the surface of the slurry to obtain a concentrate.

In the present invention, the composition C is a collector. Other reagents that can be added to the collector composition C or to any step in this process include frothers F and modifiers M. In certain embodiments, the slurry is preferably conditioned with these flotation reagents F and M to allow sufficient time for their adsorption on the respective interfaces of the mineral particles and the surrounding water, air, or fluid. The concentrate from the flotation is the value mineral, such as in the case of copper flotation. The operation may be performed in multiple stages to increase the quality of the product. The final product may be subject to secondary processing. The concentrate may be either smelted in a furnace or treated via a hydrometallurgical route, such as leaching followed by solvent extraction and electrowinning to recover the final Cu metal.

It is understood to those of ordinary skill in the art that the performance indicators in the flotation process include the recovery or yield of the value mineral and the grade or quality of the final product, as there is typically a tradeoff between these two parameters. Plants generally attempt to maximize the flotation recovery while maintaining acceptable grade or vice versa. A poorer flotation grade for the same recovery thus suggests increased flotation of unwanted gangue minerals, and increased frothing properties in certain processes.

The modifiers M are an important class of compounds which substantially enhance the selectivity of the flotation process by being present in the mixture of ground ore, water and the collector composition C. There are multiple classes of modifiers, namely dispersants such as sodium polyacrylate, sodium silicate and sodium polyphosphate. Other compounds disclosed in U.S. Pat. No. 8,720,694 B2 to Nagaraj et. al as "froth phase modifiers" are also useful. These are polymers having functional groups preferably selected from the group consisting of hydroxyl groups, hydroxamic acid or hydroxamate functional groups, silane groups, silanol groups, acid groups and acid anion groups, preferably phosphinate groups, phosphinic acid groups, carboxyl groups, carboxylate groups, carboxyl ester groups, sulfonate groups, sulfonic acid groups, phosphate groups, phosphonate groups, and phosphonic acid groups. These polymers can be accompanied by monovalent ion modifiers which are preferably alkali hydroxides or ammonium and organically substituted ammonium hydroxide. Another class of modifiers that are useful are depressants include reagents such as sodium cyanide, carboxy-methyl-cellulose and guar gum. In certain embodiments, modifiers M can include any of sodium silicate and meta-silicate, sodium phosphate and polyphosphate, carboxymethyl cellulose, guar gum, starch, tannin, lignin sulfonate, and polymers containing carboxyl, sulfonate, phosphonate and other such groups.

The frothers F provide a stable froth; examples include pine oil, aliphatic alcohols where the aliphatic organic group has from 5 to 8 carbon atoms, polyglycols, and polyglycol ethers.

Frothers F and modifiers M may be added individually or collectively to the collector composition C.

The performance of the collector composition C based on a hydroxamic acid A and/or salt S of a hydroxamic acid when used in mineral flotation processes can be enhanced by addition of other flotation additives T which are known to those skilled in the art. Accordingly, any such flotation additives can be individually or collectively added to any of the embodiments of the collector composition C or mineral flotation processes described herein.

The collector compositions C can be used for the flotation of sulfide minerals from their ores either by themselves or in combination with other collectors that have a sulfur-containing functional group such as xanthates, dithiophosphates, dithiocarbamates, thionocarbamates, monothiophosphates, and dithio-phosphinates. When value minerals are present in the oxide form sodium hydrosulfide (NaSH) can be used to activate the oxide minerals, followed by flotation with collectors that have a sulfur-containing functional group as described above. However, since only a few minerals respond to addition of NaSH and sulfide collectors, the collector compositions C according to the invention are indispensable for recovering these remaining oxide minerals.

It will also be understood by those skilled in the art that some ores contain value minerals in both sulfide and oxide form, and that a combination of the activators, collectors containing a sulfur containing functional group, and/or collector compositions C according to the invention, as determined by methods using only routine experimentation, can be used to recover all the value minerals.

The amount of hydroxamic acid A, or salt S of a hydroxamic acid, in the composition C required to effect flotation depends substantially on the mass fraction of the value mineral in the ore and can be determined using only routine methods. The preferred dosage range corresponds to a ratio of the sum of masses of hydroxamic acid A and/or salt S of hydroxamic acid to the mass of ore of from about 10 g/t to about 2000 g/t. In some embodiments, the dosage range can be about 50 g/t to about 1000 g/t. In other embodiments the dosage range can be from about 100 g/t to about 500 g/t.

The process is slightly modified for clay beneficiation, as well as the flotation of glass sands, clays and tailings. In the case of clay beneficiation, anatase is the unwanted impurity that is floated away from the value kaolinite. Substantially no grinding of the as-mined feed is required, because average particle size is of the order of a few micrometers. The major impurities in kaolin clays are anatase ($TiO_2$) and complex iron minerals, which impart color to the clay, and decrease its brightness, thus making the clay unsuitable for many of its applications where purity and brightness are absolutely essential. Conventionally, the removal of such impurities is accomplished by a variety of methods, an important one being flotation using tall oil fatty acid, or hydroxamate, or both. As a first step in carrying out this process, the clay to be purified is blunged in water at an appropriate solids concentration to form a suspension. A suitable dispersant such as polyacrylate, sodium silicate or polyphosphate is added during blunging in an amount, usually in a ratio of mass of dispersant to mass of dry solids from 1 lb/t (453.6 g/t) to about 20 lb/t (9.072 kg/t), sufficient to produce a well dispersed clay pulp. An alkali such as ammonium hydroxide is also needed to adjust the pH to above 6, and preferably in the range of from 8 to 10.5.

In accordance with the invention, the composition C preferably comprising a fatty hydroxamate Af collector can be added to the dispersed clay under usual conditions, i.e. proper agitation speeds, optimum pulp density, and adequate temperature, which permit reaction between the collector and the colored impurities of the clay in a relatively short time, generally not longer than about five to fifteen minutes.

When the clay has been conditioned after the addition of collector, it is transferred to a flotation cell, and typically diluted to a pulp density preferably corresponding to a mass fraction of solids of from 15% to 45%. The operation of the froth flotation machine is conducted in the appropriate fashion. After an appropriate period of operation, during which the titaniferous impurities are removed with the foam, the clay suspension remaining in the flotation cell can be leached for the removal of residual iron oxides, filtered and dried in any conventional fashion known in the art.

The composition C according to the present invention may be applied to the flotation of a variety of oxide minerals. Compositions C can particularly be used for the flotation of metals or minerals such as pyrochlore, fluorite, huebnerite, wolframite, cassiterite, muscovite, phosphorite, haematite, pyrolousite, rhodonite, barite, calcite and rare earths, for a number of oxidic copper minerals such as malachite, azurite, chalcanthite, tenorite, cuprite, pseudomalachite, chrysocolla, and Cu-bearing goethite.

In addition to the easier handling of the liquid composition C of the present invention, it has surprisingly been found in the experiments underlying this invention, that at the same metal recovery, the values for the grade of the concentrate obtained by flotation with the composition of the invention, as compared to aqueous or oil-based hydroxamate formulations, were increased. According to the usual meaning in mineral processing, recovery for a certain metal is the ratio of the mass of a metal found in the concentrate, divided by the total mass of the same metal in the ore of the feed, i.e., before the processing, and the grade G is the ratio of the mass m(VM) of the value metal in an ore or beneficiated ore, and the mass m(Ore) of the ore or beneficiated ore, usually expressed in the unit "%": $G=m(VM)/m(Ore)\times 100\%$.

While various embodiments may have been described herein in singular fashion, those skilled in the art will recognize that any of the embodiments described herein can be combined in the collective. The invention includes at least the following embodiments:

Embodiment 1

A collector composition C for mineral flotation comprising a water-soluble organic solvent L and at least one of a hydroxamic acid A, or a salt S of a hydroxamic acid A, dissolved in the solvent L, wherein a solvent is considered water-soluble if it forms single-phase mixtures with water for compositions ranging from a mass fraction of solvent L in the mixture with water of from 0.04 up to 1 in a temperature range of from 15° C. to 80° C.

Embodiment 2

The collector composition C of embodiment 1, wherein the solvent L is selected from the group consisting of alkylene glycols, aliphatic alcohols having from one to four carbon atoms, benzyl alcohol, polyhydric aliphatic alcohols having two or more hydroxyl groups per molecule, aliphatic sulfoxides, aliphatic sulfones, glycol ethers, aliphatic and aromatic amines, aliphatic and cycloaliphatic amides, cycloaliphatic esters, aliphatic hydroxyesters; and mixtures thereof.

Embodiment 3

The collector composition C of embodiment 2, wherein the alkylene glycol or polyhydric aliphatic alcohol having two or more hydroxyl groups per molecule is selected from the group consisting of ethylene glycol; 1,2-propylene glycol; 1,3-propanediol; 1,2-butanediol; 1,3-butanediol; 1,4-butanediol; 2,3-butanediol; 1,2-pentanediol; 1,5-pentanediol; glycerol; and mixtures thereof.

Embodiment 4

The collector composition C of embodiment 2, wherein the aliphatic alcohol is selected from the group consisting of ethanol; n-propanol; 2-propanol; isobutyl alcohol; n-butanol; amyl alcohol; and mixtures thereof.

Embodiment 5

The collector composition C of embodiment 2, wherein the glycol ether is selected from the group consisting of phenoxyethanol; propylene glycol n-propyl ether; propylene glycol n-butyl ether; 2-butoxyethanol; dipropylene glycol dimethyl ether; 2-ethoxy ethanol; 2-methoxy ethanol; and mixtures thereof.

Embodiment 6

The collector composition C of embodiment 2, wherein the solvent L is selected from the group consisting of dimethyl sulfoxide; N-methylpyrrolidone; pyridine; 1-(2-hydroxyethyl)-2-pyrrolidone; cyclohexanone; and mixtures thereof.

Embodiment 7

The collector composition C of any one of embodiments 1 to 6, wherein the solvent L comprises a mixture of any two or more solvents selected from the group consisting of 1,2-propylene glycol; 1,2-butanediol; 2,3-butanediol; glycerol; benzyl alcohol; propylene glycol n-propyl ether; phenoxyethanol; n-butanol; 2-propanol; isopropanol; dimethylsulfoxide; hydroxyethyl pyrrolidone; and N-methyl pyrrolidone.

Embodiment 8

The collector composition C of any one of embodiments 1 to 7, wherein the mass fraction of solvent L is greater than 5%; preferably greater than 10%; or more preferably greater than 20%.

Embodiment 9

The collector composition C of embodiment 8, wherein the mass fraction of solvent L is from 10% to 90%.

Embodiment 10

The collector composition C of any one of embodiments 1 to 9, wherein the hydroxamic acid A comprises a fatty hydroxamic acid Af.

Embodiment 11

The collector composition C of embodiment 10, wherein the fatty hydroxamic acid Af comprises from six to twenty-two carbon atoms in the fatty acid.

Embodiment 12

The collector composition C of embodiment 11, wherein the composition comprises a mixture of fatty hydroxamic acids Af having from eight to twelve carbon atoms.

Embodiment 13

The collector composition C of any one of embodiments 1 to 12, wherein the salt S comprises one or more of an alkali salt, an earth alkali salt, or an ammonium salt.

Embodiment 14

The collector composition C of embodiment 13, wherein the salt S comprises one or more of a salt of lithium, sodium, or potassium.

Embodiment 15

The collector composition C of any one of embodiments 1 to 14, wherein a hydroxamic acid A and a salt S of a hydroxamic acid A are both present in the composition C.

Embodiment 16

The collector composition C of embodiment 15, wherein a hydroxamic acid A and a salt S of the same hydroxamic acid A are both present in the composition C.

Embodiment 17

The collector composition C of any one of embodiments 1 to 16, wherein the sum of mass fractions of at least one of a hydroxamic acid A and/or at least one of a salt S of a hydroxamic acid present in the composition C is from 5% to 80%.

Embodiment 18

The collector composition C of embodiment 17, wherein the sum of mass fractions of at least one of a hydroxamic acid A and/or at least one of a salt S of a hydroxamic acid present in the composition C is from 14% to 50%.

Embodiment 19

The collector composition C of embodiment 18, wherein the sum of mass fractions of at least one of a hydroxamic acid A and/or at least one of a salt S of a hydroxamic acid present in the composition C is from 17% to 45%.

Embodiment 20

The collector composition C of any one of embodiments 1 to 19 further comprising a mass fraction of not more than 10%; preferably less than 5%; or more preferably less than 1% of water.

Embodiment 21

A method of recovering an oxide and/or sulfide mineral in a mineral flotation process, said method comprising the steps of a) mixing a ground ore comprising an oxide and/or sulfide mineral with a composition C according to any one of embodiments 1 to 20, and an effective amount of water in which to form a slurry;

b) subjecting the slurry to a mineral flotation process; and c) separating the mineral values from the surface of the slurry to obtain an oxide and/or sulfide mineral concentrate.

Embodiment 22

The method according to embodiment 21, wherein a modifier M is additionally present in the slurry and/or the composition C.

Embodiment 23

The method of embodiment 22 wherein the modifier M is selected from the group consisting of sodium silicate and meta-silicate, sodium phosphate and polyphosphate, carboxymethyl cellulose, guar gum, starch, tannin, lignin sulfonate, and polymers containing acid groups or acid anion groups.

Embodiment 24

The method of embodiment 23, wherein said acid or acid anion groups is chosen from one or more of carboxyl, sulfonate, or phosphonate groups.

Embodiment 25

The method of any one of embodiments 21 to 24, wherein a dosage range of the collector composition C is from 10 g/ton to 2000 g/ton; or from 50 g/ton to 1000 g/ton; or from 100 g/ton to 500 g/ton.

The following examples are provided to assist one skilled in the art to further understand certain embodiments of the present invention. These examples are intended for illustration purposes and should not be construed as limiting the scope of the present invention.

EXAMPLES

Aqueous solutions of chemicals are characterised in these examples by stating the mass fraction of dissolved chemicals. Mass fractions w(B) of a chemical compound B in the solution X are calculated as the ratio of the mass m(B) of dissolved chemical B, and the mass m(X) of the solution X:

$$w(B)=m(B)/m(X).$$

These data are usually stated in the unit "%", equal to "g/100 g" or "cg/g".

In all compositions where constituents are mentioned with a percent value (%), this value is a mass fraction.

When using mixtures of solvent 1 (abbreviated as L1) and solvent 2 (abbreviated as L2), the mass fraction of each solvent in the mixture of solvents is also stated, abbreviated as "'solvent 1' '/' 'solvent 2' '("w(L1)/%''/' 'w(L2)/%' ')'", e. g. "propylene glycol/butylene glycol (75/25)" is the abbreviation for mass fractions of propylene glycol of 75% and of butylene glycol of 25% in the mixed solvent.

A fatty hydroxamic acid or its salt is considered to essentially free from methyl esters if the mass fraction of methyl esters in the hydroxamic acid or salt product as used is less than 1.0%. If "only traces of methyl esters are found", the mass fraction of such methyl esters is not more than 0.5%.

"XRF" stands for "X Ray fluorescence" which is commonly used for quantitative chemical analysis of inorganic materials.

"AHX formulation" stands for formulations comprising (fatty) alkyl hydroxamic acid or salts thereof.

Comparative Example A

Following the procedure of Hughes, from U.S. Pat. No. 7,007,805 B2, for comparative purposes, 102.6 g of hydroxylamine sulfate were dissolved in 50 g of water in suitable three-neck reaction vessel equipped with an addition funnel, thermocouple and overhead mechanically-driven stirrer. Into the dropping funnel were added 222.2 g of a solution of potassium hydroxide in water with a mass fraction of KOH of 35%, which was then added to the stirred slurry of hydroxylamine sulfate in water while maintaining the temperature below 40° C. Once the addition of the potassium hydroxide was complete, the reaction mixture was allowed to stir for further ten minutes at room temperature (25° C.) before the potassium sulfate byproduct was removed by filtration. The filter cake was rinsed with 7 g of water. The filtrate (279.8 g) contains a mass fraction of between 15% and 16% of free hydroxylamine base, on a theoretical basis.

In an appropriate reaction vessel equipped with a mechanically-driven stirrer, thermometer and condenser, 169.7 g of methyl caprylate/caprate (a commercial mixture of $C_8$ and $C_{10}$ fatty acid methyl esters in an approximate mass ratio of 55:45) and 279.8 g of the above solution of free hydroxylamine base at 20° C. Over the course of twenty minutes, 65.5 g of solid KOH flakes (reagent grade with a mass fraction of 90% of pure KOH) were added piecewise while maintaining the temperature of the reaction mixture below 40° C. The reaction mixture was then stirred for six hours at 40° C., and a sample was drawn after this time. NMR analysis indicated an amount-of-substance fraction of less than 2% of remaining methyl esters. The pH of the resulting paste was between 11.7 and 12.2.

Comparative Example B

Following the procedure of Rothenberg, from U.S. Pat. No. 6,145,667 A, for comparative purposes, 81.4 g of hydroxylamine sulfate were dissolved in 203.3 g of water in a suitable reaction vessel equipped with addition funnel, thermocouple and overhead mechanically-driven stirrer. After the hydroxylamine sulfate was dissolved, 207.3 g of soybean oil, 3.4 g of a mixed di(octyl/decyl) dimethyl ammonium chloride solution (a commercial mixture of mass fractions of approximately 40% of octyl decyl dimethyl ammonium chloride, 16% of dioctyldimethyl-ammonium chloride, and 24% of didecyldimethylammonium chloride, 10% of water, and 10% of ethanol), and 151.8 g of methyl caprylate/caprate as above were added into the reaction flask. The reaction mixture was cooled to between 10° C. and 15° C. under stirring, and 151.4 g of an aqueous sodium hydroxide solution having a mass fraction of NaOH of 50% were added dropwise through the addition funnel while maintaining the temperature below 20° C. After the addition, the reaction mixture was warmed to between 25° C. and 30° C. and maintained within this temperature range for five hours. The completion of the reaction was monitored by NMR analysis of samples drawn. Two phases were formed by the addition of 256.0 g of aqueously diluted sulfuric acid having a mass fraction of $H_2SO_4$ of 18.75%, the phases were separated while maintaining the temperature between 30° C. and 40° C. The upper layer (390.0 g) was found to contain a mass fraction of approximately 38% of hydroxamic acid and only traces of the starting methyl esters.

Example 1

Preparation of Hydroxamic Acid

In a suitable three-neck reaction vessel, equipped with a condenser, an overhead stirrer, a thermocouple, and addition funnel, 43.1 g of hydroxylamine sulfate were dissolved in 52.7 g of water at between 20° C. and 25° C. After the hydroxylamine sulfate was dissolved, 59.4 g of methyl caprylate/caprate as above and 89.1 g of toluene were added into the reaction vessel. Through the dropping funnel, 70.0 g of an aqueous sodium hydroxide solution having a mass fraction of NaOH of 50% were added dropwise while maintaining the temperature between 30° C. and 40° C. The reaction was maintained with vigorous stirring at a temperature between 35° C. and 40° C. for five hours. Two phases were formed by the addition of 118.7 g of aqueously diluted sulfuric acid having a mass fraction of $H_2SO_4$ of 15% and 90.2 g of additional toluene, with the lower layer having a pH between 7 and 7.5. The phases were separated and the upper organic layer (245.1 g) was found to contain a mass fraction of 22.5% of hydroxamic acid, corresponding to a 92% yield. The toluene in the organic phase was then removed to give the hydroxamic acid product. 275.7 g of propylene glycol were added to the product to make a liquid solution of the hydroxamic acid having a mass fraction of 20% of hydroxamic acid. This solution was essentially free from starting methyl esters.

Example 1a 1,2-butanediol

The procedure outlined in Example 1 was followed except 325 g of the resulting hydroxamic acid product after removal of the toluene were dissolved in 675 g of 1,2-butanediol. The liquid solution was found to contain a mass fraction of hydroxamic acid of approximately 30%, and was essentially free from starting methyl esters.

Example 1b

Propylene Glycol Mixed with 1,2-butanediol

The procedure outlined in Example 1 was followed except 325 g of the resulting hydroxamic acid product after removal of the toluene were dissolved in 506 g of propylene glycol and 169 g of 1,2-butanediol. The liquid solution was found to contain a mass fraction of hydroxamic acid of approximately 30%, and was essentially free from starting methyl esters.

Example 1c

Propylene Glycol n-Propyl Ether

The procedure outlined in Example 1 was followed except 325 g of the resulting hydroxamic acid product after removal of the toluene were dissolved in 675 g of propylene glycol n-propyl ether. The liquid solution was found to contain a mass fraction of hydroxamic acid of approximately 30%, and was essentially free from starting methyl esters.

Example 1d

NMP

The procedure outlined in Example 1 was followed except 433.4 g of the resulting hydroxamic acid product after removal of the toluene were dissolved in 566.6 g of N-methylpyrrolidone. The liquid solution was found to contain a mass fraction of hydroxamic acid of approximately 40%, and was essentially free from starting methyl esters.

Example 1e 2-butoxyethanol

The procedure outlined in Example 1 was followed except 325 g of the resulting hydroxamic acid product after removal of the toluene were dissolved in 675 g of 2-butoxyethanol. The liquid solution was found to contain a mass fraction of hydroxamic acid of approximately 30%, and was essentialy free from starting methyl esters.

Example 2

Preparation of Salt of a Hydroxamic Acid

In a suitable three-neck reaction vessel, equipped with a condenser, an overhead stirrer, a thermocouple, and addition funnel, 86.2 g of hydroxylamine sulfate were dissolved in 105.4 g of water at a temperature between 20° C. and 25° C. After the hydroxylamine sulfate was dissolved, 118.8 g of methyl caprylate/caprate ($C_8$- and $C_{10}$-fatty acid methyl ester mixture in a mass ratio of 1.9:1) and 297.0 g of toluene were added into the reaction vessel. Through the dropping funnel, 140 g of an aqueous sodium hydroxide solution having a mass fraction of NaOH of 50% were added dropwise while maintaining the temperature between 30° C. and 40° C. The reaction was maintained with vigorous stirring at a temperature between 35° C. and 40° C. for five hours. Two phases were formed by the addition of 237.5 g of aqueously diluted sulfuric acid having a mass fraction of $H_2SO_4$ of 15%, and 180.3 g of additional toluene, with the lower layer having a pH between 7 and 7.5. The phases were separated and the upper organic layer was found to contain a mass fraction of hydroxamic acid of 24.2%. The toluene in the organic phase was then removed by distillation to give 119.0 g of hydroxamic acid product. A portion of this product (33.7 parts) was dissolved in propylene glycol (66.3 parts), and was added back to the resulting product to make a liquid solution with a mass fraction of the hydroxamic acid of 30%. This solution was essentially free from starting methyl esters.

Example 3

Flotation Tests on Cu Oxide Ores 500 g of a copper sulfide-oxide mixed ore sample with an average particle size of 2 mm were prepared by grinding the ore in a rod mill with a rod charge of 7 kg and 325 g of water for eight minutes. The ground ore had a particle size distribution so that 80% of the mass of the particles was passing a mesh with a nominal aperture of 100 μm, and it was transferred to a flotation cell having a working volume of 1.25 L, resulting in an aqueous slurry having a mass fraction of solids of 33%. The head grade G of the ore corresponds to a mass fraction of copper of 4.5% for the total copper present in the ore, and 3.5% for acid soluble copper. The acid soluble copper is what is considered amenable to flotation using the present invention.

In the following flotation experiments, the dosage of hydroxamic acid and its salts, calculated as described supra, is adjusted to meet the dosage values as stated hereinafter. For the sum of hydroxamic acid and hydroxamate salts, the mass fraction or dosage is always 100 g/t.

Flotation

The slurry was first treated with sodium isobutyl xanthate, which is a sulfide collector added to recover the sulfide minerals present, at a dosage of 50 g/t (mass of collector, divided by mass of ore), and conditioned for two minutes. The airflow was turned on and set to 2.5 L/min, and flotation was conducted for five minutes.

Following this, sodium hydrosulfide was dosed into the slurry at a dosage of 1800 g/t. Sodium isobutyl xanthate was also added at a dosage of 50 g/t. The airflow was turned on and flotation was carried out for five minutes.

Following this, sodium hydrosulfide was dosed into the slurry at a dosage of 600 g/t. Sodium isobutyl xanthate was also added at a dosage of 50 g/t. The airflow was turned on and flotation was carried out for five minutes.

Following this, fatty hydroxamic acid (kind—see table 1) was dosed into the cell at a dosage of 100 g/t. The hydroxamic acid or its salt was prepared using the methods described in the various patents, in the comparative runs.

Following this, fatty hydroxamic acid (kind—see table 1) was dosed into the cell, once again, at a dosage of 100 g/t. The hydroxamic acid or its salt was prepared using the methods described in the various patents, in the comparative runs.

The performance of the reagent was assessed with flotation concentrate grade G parameter. It is reflective of the frothing properties, i.e. a formulation delivering improved frothing properties will result in a higher grade. A curve is drawn connecting the cumulative recovery and grade after each concentrate. The grade G achieved for a 65% recovery is listed in the table below. The dosage of hydroxamic acid and its salts had been adjusted to 100 g/t in all cases, to ensure equal bases for all experiments.

TABLE 1

| Run No. | Hydroxamic acid method of preparation | Copper Concentrate Grade for 65% Recovery |
|---|---|---|
| 1C | U.S. Pat. No. 6,739,454B2- mixture of C8-C10 AHX acid prepared in soybean oil | 7.24% |
| 2C | U.S. Pat. No. 7,007,805B2- C8 hydroxamate potassium salt, prepared as a paste | 7.5% |
| 3C | U.S. Pat. No. 7,007,805B2- C8 hydroxamate potassium salt paste dispersed in 1% aqueous solution of KOH | 7.4% |
| 4 | Present invention- C8 (55%)-C10 (45%) AHX prepared as a 20% solution in propylene glycol. | 9.24% |
| 5 | Present invention- C8 (55%)-C10 (45%) AHX prepared as a 40% solution in N-methyl pyrrolidone. | 10.15% |
| 6 | Present invention- C8 hydroxamic acid prepared as a 30% solution in propylene glycol | 7.95% |
| 7 | Present invention- C8 hydroxamic acid potassium salt prepared as a 20% solution in propylene glycol. | 7.7% |
| 8 | Present invention- C8 (55%)-C10 (45%) hydroxamic acid prepared as a 30% solution in propylene glycol and butylene glycol (75:25) | 10.3% |
| 9 | Present invention C8 (65%) and -C10 (35%) hydroxamic acid prepared as a 30% solution in propylene glycol | 9.63% |
| 10 | Present invention C8 (65%) and C10 (35%) hydroxamic acid prepared as a 35% solution in a mixture of propylene glycol and butylene glycol (75:25). | 9.28% |

Example 4 pH Measurements to Determine Hazardous Nature of Products

An Orion pH probe was first calibrated via a three-point calibration by using standard pH buffer solutions of pH 4.0, 7.0 and 10.0. Approximately 10 g of each of the AHX formulations was mixed with 1.0 g of a mixture of methanol and water (volume ratio of methanol to water was 2:1) and stirred until a homogeneous solution was obtained. The pH probe was then inserted into the solution until the pH value on the meter reached a steady value. A pH value above 10 is considered difficult to handle, as precautions need to be taken. Results are listed in table 2.

TABLE 2

| Example | Product | pH |
|---|---|---|
| 4.1 | U.S. Pat. No. 7,007,805B2 - C8 hydroxamate potassium salt, prepared as a paste | 13.5 |
| 4.2 | Present invention - C8/C10 hydroxamic acid (55:45 mass ratio) prepared as a 20 wt % solution in propylene glycol | 7.1 |
| 4.3 | Present invention - C8 hydroxamic acid prepared as a 30% solution in propylene glycol | 7.5 |
| 4.4 | Present invention - Enriched C8/C8-C10 hydroxamic acid (65:35 mass ratio) prepared as a 33% solution in propylene glycol/1,2-butanediol (3:1 mass ratio) | 8.1 |

Example 5

Flotation Tests on Mixed Oxide/Sulfide Copper Ores 500 g of a copper sulfide-oxide mixed ore sample was prepared by grinding the ore in a rod mill with a rod charge of 7 kg and 325 g of water for eight minutes. The ground ore had a particle size so that a mass fraction of 80% thereof was passing through a screen with a mesh width of 100 μm, and it was transferred to a flotation cell having a working volume of 1.25 L, resulting in an aqueous slurry having a mass fraction of solids of 33%. The head grade of the ore corresponds to a mass fraction of copper of 1.8%, a mass fraction of 1.5% being acid soluble copper. The acid soluble copper is what is considered amenable to flotation using the present invention.

Sodium hydrosulfide was dosed into the slurry at a dosage of 600 g/t. Sodium isobutyl xanthate was also added at a dosage of 50 g/t. A modifier, sodium hexametaphosphate was added to the slurry at a dosage of 500 g/t. The airflow was turned on and flotation was carried out for five minutes. Following this, sodium hydrosulfide was dosed into the slurry at a dosage of 400 g/t. Sodium isobutyl xanthate was also added at a dosage of 50 g/t. The airflow was turned on and flotation was carried out for five minutes. Following this, a fatty hydroxamic acid (details—see table 3) was dosed into the cell at a dosage of 100 g/t. The hydroxamic acid or its salt was prepared using the methods described in the various patents for the comparative examples and the present invention. A modifier, sodium hexametaphosphate, was added to the slurry at a dosage of 500 g/t. Following this, a fatty hydroxamic acid (details—see table 3) was dosed into the cell at a dosage of 100 g/t. The hydroxamic acid or its salt was prepared using the methods described in the various patents. Following this, a fatty hydroxamic acid (details—see table 3) was dosed into the cell at a dosage of 100 g/t.

The performance of the reagent was assessed with flotation concentrate grade parameter. It is also reflective of the frothing properties, i.e., a formulation delivering improved frothing properties will result in a higher grade. A curve was drawn connecting the cumulative recovery and grade after each concentration step. The grade achieved for a recovery of 65% of the mass of the copper present in the ore is listed in table 3 below.

TABLE 3

| Run No. | Hydroxamic acid method of preparation | Copper Concentrate Grade for 65% Recovery |
|---|---|---|
| 11C | U.S. Pat. No. 6,739,454B2- mixture of C8-C10 AHX acid prepared in soybean oil | 5.14% |
| 12C | U.S. Pat. No. 7,007,805B2- C8 hydroxamate potassium salt, prepared as a paste | 4.28% |
| 13C | U.S. Pat. No. 7,007,805B2- C8 hydroxamate potassium salt paste dispersed in 1% aqueous KOH solution | 5.08% |
| 14 | Present invention- C8 (55%)-C10 (45%) alkyl hydroxamic acid prepared as a 20% solution in propylene glycol. | 5.77% |
| 15 | Present invention- C8 hydroxamic acid prepared as a 30% solution in propylene glycol | 5.85% |
| 16 | Present invention- C12 hydroxamic acid prepared as a 30% solution in propylene glycol. | 6.10% |

Example 6

Flotation Tests on Rare-Earth Metals Containing Ore

A sample of rare earth ore was obtained from a mine in Asia. 500 g of an ore sample with an average particle size of 2 mm was prepared by grinding the ore in a rod mill with a rod charge of 7 kg and 325 g of water for two minutes. The ground ore had a particle size so that a mass fraction of 80% thereof was passing through a screen with a mesh width of 100 μm, and it was transferred to a flotation cell having a working volume of 1.25 L, resulting in slurry having a mass fraction of solids of 33%. The important rare earth elements present in the ore were Cerium (Ce; mass fraction of Ce in the ore: w(Ce)=1.81%), Lanthanum (La; w(La)=1.97%) and Neodymium (Nd; w(Nd)=0.47%).

Flotation

In order to conduct the flotation test, alkyl hydroxamic acid, prepared as described in the table 4 below, was added to the flotation cell at a dosage of 100 g/t. Airflow was set to 2.5 L/min, and turned on, and flotation was conducted for five minutes to generate the first concentrate.

Following this, alkyl hydroxamic acid (details—see table 4) was added at a dosage of 100 g/t and conditioned by mixing for five minutes. Airflow was set to 2.5 L per minute, turned on for five minutes and a second concentrate was collected.

Following this, alkyl hydroxamic acid (details—see table 4) was added at a dosage of 100 g/t and conditioned for five minutes. Airflow was set to 2.5 L per minute, turned on for five minutes and a third concentrate was collected.

All samples, including the tailings from flotation were dried and assayed for Cerium, Lanthanum and Neodymium by XRF. The samples were pulverized before XRF was conducted. The flotation recovery and grades were calculated to generate a grade-recovery curve, as is standard procedure to assess flotation performance. The concentrate grade achieved to obtain a recovery of 50% for each test is recorded in table 4 below.

TABLE 4

| Run No. | Hydroxamic acid method of preparation | Cerium Concentrate Grade for 50% Recovery | Lanthanum Concentrate Grade for 50% Recovery | Neodymium Concentrate Grade for 50% Recovery |
|---|---|---|---|---|
| 17C | U.S. Pat. No. 6,739,454B2- mixture of C8-C10 AHX prepared in soybean oil | 2.25% | 2.5% | 0.5% |
| 18 | Present invention C8-C10 AHX prepared as 20% solution in propylene glycol | 3% | 3% | 0.65% |

Example 7

Flotation Test on Fe Oxide Containing Ore

A sample of an iron ore was obtained from a mine in North America. The ore sample was pre-ground and obtained in 400 g test charges from the minesite. The particle size of the ore was so that a mass fraction of 80% thereof was passing through a screen with a mesh width of 75 μm. It was transferred to a flotation cell having a working volume of 1.25 L, resulting in a slurry having a mass fraction of solids of 25%. The main value mineral was haematite ($Fe_2O_3$) with a grade of 25%, and the major gangue was silica ($SiO_2$).

In the first stage of flotation, corn-starch, a well-known silica depressant, was added, and conditioned by mixing for five minutes. Alkyl hydroxamic acid, prepared as described in table 5 below, was added to the flotation cell at a dosage of 100 g/t. Airflow was set to 2.5 L/min, and turned on, and flotation was conducted for five minutes to generate the first concentrate.

Following this, again, alkyl hydroxamic acid was added to the first concentrate at a dosage of 100 g/t and conditioned by mixing for five minutes. Airflow was set to 2.5 L/min, turned on for five minutes and a second concentrate was collected.

Following this, again, alkyl hydroxamic acid was added to the second concentrate at a dosage of 100 g/t and conditioned for five minutes. Airflow was set to 2.5 L/min, turned on for five minutes and a third concentrate was collected.

All samples, including the tailings from flotation were dried and assayed for Fe and Si by XRF. The samples were pulverized before XRF was conducted. The flotation recovery and grades were calculated to generate a grade-recovery curve, as is standard procedure to assess flotation performance. The concentrate grade achieved to obtain a recovery of 83% on the curve for each test is recorded in table 5 below.

TABLE 5

| Run No. | Hydroxamic acid method of preparation | Iron Concentrate Grade for 83% Recovery |
|---|---|---|
| 19C | U.S. Pat. No. 7,007,805B2- C8 hydroxamate potassium salt, prepared as a paste | 37% |
| 20C | U.S. Pat. No. 6,739,454B2- mixture of C8-C10 AHX acid prepared in soybean oil | 41% |
| 21 | Present invention C8-C10 AHX prepared as 20% solution in propylene glycol | 42% |

Example 8

Flotation Tests on Sulfide Ore with Au Values 500 g of an Au ore (most Au values present in sulfides) sample with and average particle size of (2 mm) was prepared by grinding the ore in a rod mill with a 6 kg rod charge and 333 g of water for 17.5 minutes. The ground ore had a particle size distribution so that 80% of the mass of the particles was passing a mesh with a nominal aperture of 100 um. The ground ore slurry is then transferred to a flotation cell of a working volume of 1.25 L, 667 ml of water is added to the cell to produce final ore slurry with a 33% mass fraction of solids. The head grade of the ore corresponds to a 1.1% mass fraction of (S) present in the ore.

Flotation

The slurry was agitated in a Denver cell at and impeller speed of 900-1000 rpm. The agitated slurry is treated with 100 g/t of the fatty hydroxamic acid prepared (as described in table 6) and allowed to condition the slurry for 2 minutes. 15 g/t of frother was then introduced to the cell and allowed to condition for another minute. Air was then introduced through the impeller between 4-7 L/min. A flotation concentrate is collected 15 seconds after initiation of the air flow and collected every 15 seconds for the 9 minute duration of the flotation.

TABLE 6

| Run No. | Hydroxamic acid method of preparation | Sulfur concentrate grade for 65% recovery |
|---|---|---|
| 22C | U.S. Pat. No. 6,739,454B2- Mixture of C8-C10 AHX acid prepared in soyabean oil | 4% |
| 23 | Present invention C8(65%)-C10(35%) alkyl hydroxamic acid prepared as a 20% solution in propylene glycol | 8.5% |

In view of the above description and the examples, one of ordinary skill in the art will be able to practice the invention as claimed without undue experimentation. Although the foregoing description has shown, described, and pointed out the fundamental novel features of certain embodiments of the present invention, it will be understood that various omissions, substitutions, and changes in the form of the detail of the invention as described may be made by those skilled in the art, without departing from the scope of the present teachings. Consequently, the scope of the present invention should not be limited to the foregoing description or discussion, but should be defined by the appended claims.

We claim:

1. A mineral flotation collector composition "C" comprising a water-soluble organic solvent "L" selected from the group consisting of alkylene glycols, benzyl alcohol, polyhydric aliphatic alcohols having two or more hydroxyl groups per molecule, aliphatic sulfoxides, aliphatic sulfones, glycol ethers, aliphatic and aromatic amines, aliphatic and cycloaliphatic amides, cycloaliphatic esters, aliphatic hydroxyesters; and mixtures thereof; and at least one of a hydroxamic acid "A", or a salt "S" of a hydroxamic acid A, dissolved in the solvent L, wherein a solvent is considered water-soluble if it forms single-phase mixtures with water for compositions ranging from a mass fraction of solvent L in the mixture with water of from 0.04 up to 1 in a temperature range of from 15° C. to 80° C.

2. The collector composition C of claim 1, wherein the alkylene glycol or polyhydric aliphatic alcohol having two or more hydroxyl groups per molecule is selected from the group consisting of ethylene glycol; 1,2-propanediol; 1,3-propanediol; 1,2-butanediol; 1,3-butanediol; 1,4-butanediol; 2,3-butanediol; 1,2-pentanediol; 1,5-pentanediol; glycerol; and mixtures thereof.

3. The collector composition C of claim 1, wherein the glycol ether is selected from the group consisting of phenoxyethanol; propylene glycol n-propyl ether; propylene glycol n-butyl ether; 2-butoxyethanol; dipropylene glycol dimethyl ether; 2-ethoxy ethanol; 2-methoxy ethanol; and mixtures thereof.

4. The collector composition C of claim 1, wherein the solvent L is selected from the group consisting of dimethyl sulfoxide; N-methylpyrrolidone; pyridine; 1-(2-hydroxyethyl)-2-pyrrolidone; cyclohexanone; and mixtures thereof.

5. The collector composition C of claim 1, wherein the solvent L comprises a mixture of any two or more solvents selected from the group consisting of 1,2-propanediol; 1,2-butanediol; 2,3-butanediol; glycerol; benzyl alcohol; propylene glycol n-propyl ether; phenoxyethanol; dimethylsulfoxide; hydroxyethyl pyrrolidone; and N-methyl pyrrolidone.

6. The collector composition C of claim 1, wherein the mass fraction of solvent L is greater than 5%.

7. The collector composition C of claim 6, wherein the mass fraction of solvent L is from 10% to 90%.

8. The collector composition C of claim 1, wherein the hydroxamic acid A comprises a fatty hydroxamic acid "Af".

9. The collector composition C of claim 8, wherein the fatty hydroxamic acid Af comprises from six to twenty-two carbon atoms in the fatty acid.

10. The collector composition C of claim 9, wherein the composition comprises a mixture of fatty hydroxamic acids Af having from eight to twelve carbon atoms.

11. The collector composition C of claim 1, wherein the salt S comprises one or more of an alkali salt, an earth alkali salt, or an ammonium salt.

12. The collector composition C of claim 11, wherein the salt S comprises one or more of a salt of lithium, sodium, or potassium.

13. The collector composition C of claim 1, wherein a hydroxamic acid A and a salt S of a hydroxamic acid A are both present in the composition C.

14. The collector composition C of claim 13, wherein a hydroxamic acid A and a salt S of the same hydroxamic acid A are both present in the composition C.

15. The collector composition C of claim 1, wherein the sum of mass fractions of at least one of a hydroxamic acid A and/or at least one of a salt S of a hydroxamic acid present in the composition C is from 5% to 80%.

16. The collector composition C of claim 15, wherein the sum of mass fractions of at least one of a hydroxamic acid A and/or at least one of a salt S of a hydroxamic acid present in the composition C is from 14% to 50%.

17. The collector composition C of claim 16, wherein the sum of mass fractions of at least one of a hydroxamic acid A and/or at least one of a salt S of a hydroxamic acid present in the composition C is from 17% to 45%.

18. The collector composition C of claim 1 further comprising a mass fraction of water of less than 5%.

19. A method of recovering an oxide and/or sulfide mineral in a mineral flotation process, said method comprising the steps of a) mixing a ground ore comprising an oxide and/or sulfide mineral with a mineral flotation collector composition "C" as defined by claim 1, and an effective amount of water in which to form a slurry;

b) subjecting the slurry to a mineral flotation process; and c) separating the mineral values from the surface of the slurry to obtain an oxide and/or sulfide mineral concentrate.

20. The method according to claim 19, wherein a modifier "M" is additionally present in the slurry and/or the collector composition C.

21. The method of claim 20 wherein the modifier M is selected from the group consisting of sodium silicate; metasilicate, sodium phosphate, polyphosphate, carboxymethyl cellulose, guar gum, starch, tannin, lignin sulfonate, polymers containing acid groups or acid anion groups; and mixtures thereof.

22. The method of claim 21, wherein said acid or acid anion groups is chosen from one or more of carboxyl, sulfonate, or phosphonate groups.

23. The method of claim 19, wherein a dosage range of the collector composition C is from 10 g/ton to 2000 g/ton.

24. The method of claim 23, wherein the dosage range of the collector composition C is from 50 g/ton to 1000 g/ton.

25. The method of claim 24, wherein the dosage range of the collector composition C is from 100 g/ton to 500 g/ton.

26. A mineral flotation collector composition "C" comprising at least one hydroxamic acid "A", and/or a salt "S" of a hydroxamic acid A, in a total mass fraction from 5% to 80%, and a water-soluble organic solvent "L" selected from the group consisting of 1,2-propanediol; 1,2-butanediol; 2,3-butanediol; glycerol; benzyl alcohol; propylene glycol n-propyl ether; phenoxyethanol; dimethylsulfoxide; hydroxyethyl pyrrolidone; and N-methyl pyrrolidone; and mixtures thereof in a mass fraction from 10% to 90%, wherein a solvent is considered water-soluble if it forms single-phase mixtures with water for compositions ranging from a mass fraction of solvent L in the mixture with water of from 0.04 up to 1 in a temperature range of from 15° C. to 80° C.

27. The collector composition C of claim 26, wherein the hydroxamic acid A includes a mixture of alkyl hydroxamic acids having from six to twelve carbon atoms, and is present in a total mass fraction of 17% to 45%, and wherein the solvent L includes a mixture of propylene glycol and 1,2-butylene glycol in a total mass fraction of greater than 20%.

28. The collector composition C of claim 27, wherein the collector composition C is essentially free of water and essentially free of surfactants.

* * * * *